US012760235B2

(12) United States Patent
Miles et al.

(10) Patent No.: US 12,760,235 B2
(45) Date of Patent: Oct. 13, 2026

(54) OIL-IN-WATER EMULSIONS

(71) Applicants: QUADRISE INTERNATIONAL LTD, London (GB); NOURYON CHEMICALS INTERNATIONAL B.V., Arnhem (NL)

(72) Inventors: Jason Victor Miles, London (GB); Patrick Brunelle, London (GB); Dennis Selse, Myggenäs (SE)

(73) Assignees: Quadrise International Ltd (GB); Nouryon Chemicals International B.V. (NL)

( * ) Notice: Subject to any disclaimer, the term of this patent is extended or adjusted under 35 U.S.C. 154(b) by 0 days.

(21) Appl. No.: 18/255,658

(22) PCT Filed: Dec. 3, 2021

(86) PCT No.: PCT/GB2021/053177
§ 371 (c)(1),
(2) Date: Jun. 2, 2023

(87) PCT Pub. No.: WO2022/118044
PCT Pub. Date: Jun. 9, 2022

(65) Prior Publication Data

US 2024/0010942 A1 Jan. 11, 2024

(30) Foreign Application Priority Data

Dec. 3, 2020 (GB) ..... 2019106

(51) Int. Cl.
*C10L 1/32* (2006.01)
*C10L 1/182* (2006.01)

(52) U.S. Cl.
CPC ..... *C10L 1/328* (2013.01); *C10L 1/1826* (2013.01); *C10L 2250/082* (2013.01);
(Continued)

(58) Field of Classification Search
CPC .. C10L 1/328; C10L 1/1826; C10L 2250/082; C10L 2270/026; C10L 2270/04;
(Continued)

(56) References Cited

U.S. PATENT DOCUMENTS 5,283,001 A * 2/1994 Gregoli ..... B01F 23/49 516/929
2006/0258555 A1* 11/2006 Filippini ..... C09D 9/04 510/417

(Continued)

FOREIGN PATENT DOCUMENTS

GB 489372 A 7/1938
GB 1147867 A 4/1969

(Continued)

OTHER PUBLICATIONS

International Search Report and Written Opinion for Application No. PCT/GB2021/053177, mailed Mar. 9, 2022, 9 pages.

(Continued)

*Primary Examiner* — Taiwo Oladapo
(74) *Attorney, Agent, or Firm* — Julie K. Staple; Fishman Stewart PLLC

(57) ABSTRACT

This invention relates to oil-in-water (water continuous) emulsions that can be used as fuels, in particular oil-in-water emulsions comprising glycerol. The invention also relates to a process for their preparation and to fuel compositions comprising such emulsions.

18 Claims, 5 Drawing Sheets

(52) U.S. Cl.
CPC ..... *C10L 2270/026* (2013.01); *C10L 2270/04* (2013.01); *C10L 2290/24* (2013.01)

(58) Field of Classification Search
CPC .. C10L 2290/24; C10L 1/1824; C10L 1/1881; C10L 1/1883; C10L 1/189; C10L 1/2222; C10L 1/2225; C10L 1/2364; C10L 1/2366; C10L 1/2387; C10L 1/2437; C10L 2200/0453; C10L 2200/0469; C10L 2250/06; C10L 2290/06
See application file for complete search history.

(56) References Cited

U.S. PATENT DOCUMENTS

2007/0161832 A1* 7/2007 Myllyoja ..... C07C 1/22 585/21
2014/0303408 A1* 10/2014 Zaher ..... C07C 29/86 568/913
2018/0320096 A1* 11/2018 Craige ..... C10L 1/2222

FOREIGN PATENT DOCUMENTS

| | | | | | |
|---|---|---|---|---|---|
| GB | 2562381 | A | * | 11/2018 | ..... B01F 17/0042 |
| JP | 277396 | A | | 10/1996 | |
| WO | WO-2004099350 | A1 | * | 11/2004 | ..... C10L 1/10 |
| WO | 2010/086619 | A1 | | 8/2010 | |
| WO | WO-2010123865 | A2 | * | 10/2010 | ..... A61K 31/185 |
| WO | WO-2015175876 | A1 | * | 11/2015 | ..... C10L 1/12 |
| WO | 2017/077302 | A2 | | 5/2017 | |
| WO | 2018/206904 | A2 | | 11/2018 | |
| WO | 2018/206963 | A1 | | 11/2018 | |

OTHER PUBLICATIONS

GB Intellectual Property Office Search Report for Application No. GB2019106.0 dated May 20, 2021, 4 pages.

* cited by examiner

OIL-IN-WATER EMULSIONS

CROSS-REFERENCE TO RELATED APPLICATIONS

This application claims priority to PCT International Patent Application Serial No. PCT/GB2021/053177, filed Dec. 3, 2021, which claims priority to GB Patent Application No. 2019106.0, filed on Dec. 3, 2020, the entire content of both of which is incorporated herein by reference.

TECHNICAL FIELD

This invention relates to oil-in-water (water continuous) emulsions that can be used as fuels, in particular oil-in-water emulsions comprising glycerol. The invention also relates to a process for their preparation and to fuel compositions comprising such emulsions.

BACKGROUND

Conventional heavy fuel oils are normally produced by blending viscous refinery residues with higher value distillate fuels to provide the lower viscosity characteristics required for acceptable fuel handling and combustion performance. Direct use of high viscosity refinery residues requires high-temperature storage and handling that limits and complicates their potential use, and consequently lowers their value. As an alternative to blending refinery residues for fuel oil production, further processing (e.g. coking, hydrocracking, etc.) of the residue can be applied at the refinery to yield additional distillate fuels. This strategy requires large capital investments to be made by the oil refinery, produces some lower value products, generates difficult to market by-products, and results in an increase of emissions (including greenhouse and acid gases), all of which can serve to limit the economic advantage of this approach. Furthermore, the burning of conventional fuel oils is linked to key environmental problems including the emission of black Soot, NOx & SOx.

WO2017077302A2 discloses an oil-in-water emulsion which comprises an oil phase, an aqueous phase, and a primary surfactant. WO2018206963A1 discloses an oil-in-water emulsion which comprises a polymeric stabiliser selected from cationic polymers. WO2015175876A discusses a glycerol/water-in-oil emulsion which comprises biodiesel

SUMMARY OF INVENTION

The present invention is directed to an oil-in-water emulsion, particularly a fuel such as a marine fuel or a fuel oil for use in heat and power generation applications.

Accordingly, there is provided an oil-in-water emulsion comprising an oil phase dispersed in an aqueous phase, the oil-in-water emulsion comprising:

- from 0.05 to 0.6 wt % of a surfactant selected from the group consisting of fatty alkyl amines, ethoxylated fatty alkylamines, ethoxylated fatty alkyl monoamines, methylated fatty alkyl monoamines, methylated fatty alkyl amines, and quaternary fatty alkyl amines, or a combination thereof; and
- from 0.5 to 70 wt % glycerol;
- wherein the oil-in-water emulsion has the following characteristics:

- an average droplet size (D[4,3]) of from 3 to 15 μm;
  - less than 3 wt % of the droplets have a particle size of greater than 125 μm; and
  - a dynamic viscosity of up to 500 mPas at 50° C. and 100 $s^{-1}$ wherein viscosity is measured on a Malvern Kinexus™ instrument.

A further aspect provides a fuel composition comprising or consisting of the oil-in-water emulsion as defined in the first aspect.

A further aspect provides a process for preparing the oil-in-water emulsion fuel as defined in the first aspect, the process comprising the steps of:

- heating a hydrocarbon-containing oil and optionally glycerol to form the oil phase;
- mixing water, the surfactant, and optionally glycerol to form an aqueous solution; and
- blending the oil phase and the aqueous solution under conditions sufficient to form an oil-in-water emulsion;
- wherein glycerol is present in the oil phase, or in the aqueous phase, or in the oil phase and the aqueous phase.

BRIEF DESCRIPTION OF THE DRAWINGS

The present invention will now be described with reference to the accompanying drawings, in which.

DETAILED DESCRIPTION

Figure 1:
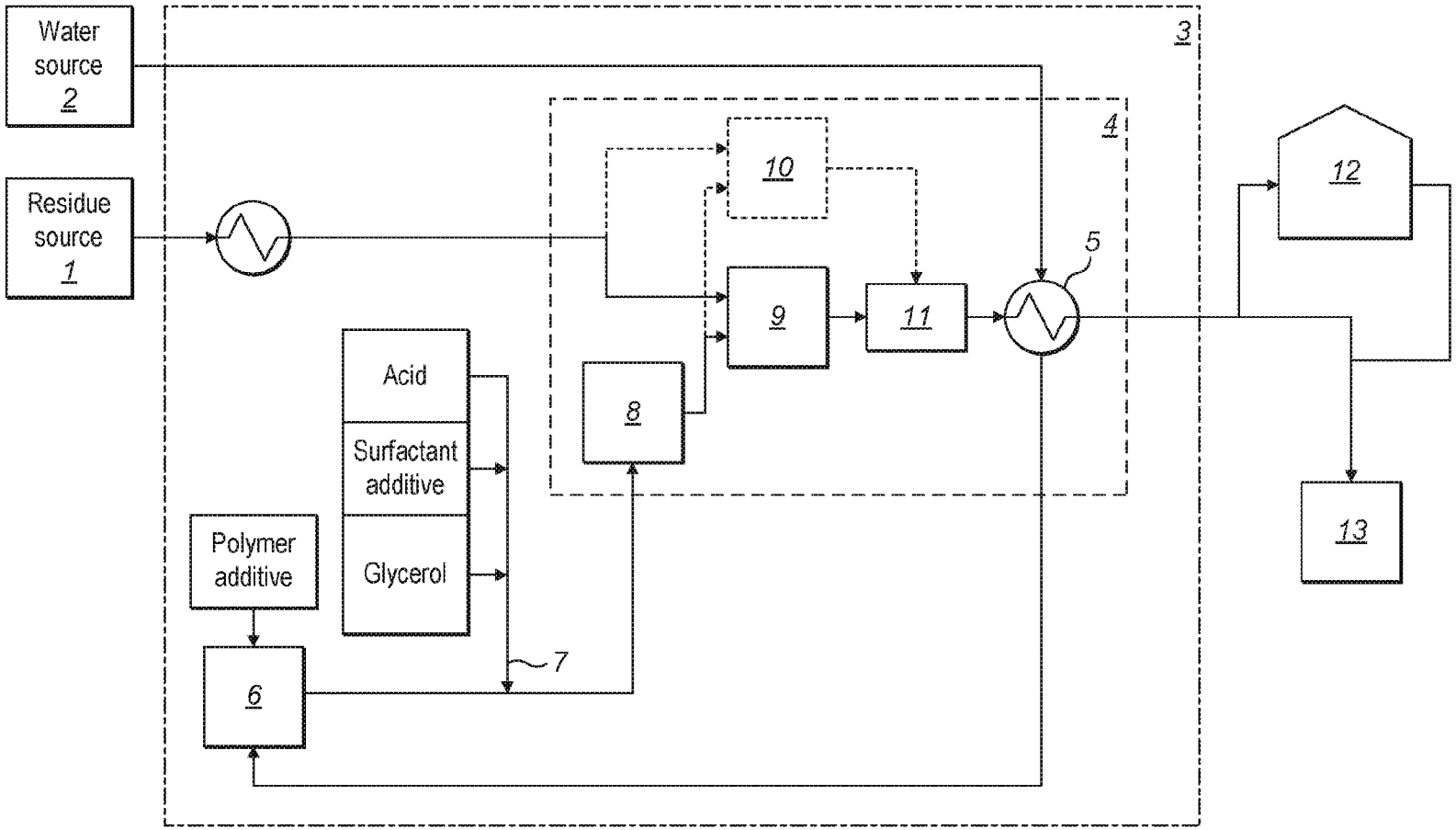
FIG. 1 shows a schematic of a process for producing an oil-in-water emulsion wherein glycerol is present in the aqueous phase, as described herein.

The oil-in-water emulsions according to the present invention are suitable for use as marine fuel, and as fuel oil for heat and power utility applications. The use of the oil-in-water fuel emulsions according to the invention may reduce emissions of nitrogen oxides (NOx), particulate matter (especially black soot) and ash, carbon dioxide ($CO_2$) and sulphur dioxide ($SO_2$) emissions, and may provide economic, environmental and handling advantages over known fuels.

As a first embodiment, there is provided an oil-in-water emulsion comprising an oil phase dispersed in an aqueous phase, the oil-in-water emulsion comprising:

- from 0.05 to 0.6 wt % of a surfactant selected from the group consisting of fatty alkyl amines, ethoxylated fatty alkylamines, ethoxylated fatty alkyl monoamines, methylated fatty alkyl monoamines, methylated fatty alkyl amines, and quaternary fatty alkyl amines, or a combination thereof; and
- from 0.5 to 70 wt % glycerol;
- wherein the oil-in-water emulsion has the following characteristics:
  - an average droplet size (D[4,3]) of from 3 to 15 μm;
  - less than 3 wt % of the droplets have a particle size of greater than 125 μm; and a dynamic viscosity of up to 500 mPas at 50° C. and 100 $s^{-1}$, wherein viscosity is measured on a Malvern Kinexus™ instrument.

As a second embodiment, there is provided an oil-in-water emulsion according to the first aspect, wherein the oil of the oil-phase comprises a hydrocarbon residue derived from one or more of; processed heavy crude oil or natural bitumen; refinery atmospheric distillation; refinery vacuum distillation; refinery visbreaking, thermal cracking or steam cracking; refinery cat-cracking; refinery hydroprocessing and hydrocracking; and de-asphalting processes; and/or the hydrocarbon is a hydrocarbon residue selected from those having Chemical Abstracts Service (CAS) Registry Numbers 8052-42-4, 64741-45-3, 64741-56-6, 64741-67-9, 64741-75-9, 64741-80-6, 64742-07-0, 64742-78-5, 64742-85-4, 68748-13-7, 68783-13-1, 70913-85-8, 91995-23-2 or 92062-05-0, or combinations thereof.

As a third embodiment, there is provided an oil-in-water emulsion according to any previous aspect, comprising up to 70 wt % hydrocarbon residue, wherein the sum of components in the emulsion does not exceed 100 wt %.

As a further embodiment, there is provided an oil-in-water emulsion according to any previous aspect, comprising from about 40 to about 60 wt % hydrocarbon residue, wherein the sum of components in the emulsion does not exceed 100 wt %. For example, the oil-in-water emulsion may comprise about 40, about 50 or about 60 wt % hydrocarbon residue, wherein the sum of components in the emulsion does not exceed 100 wt %.

As a further embodiment, there is provided an oil-in-water emulsion according to any previous aspect, comprising up to 50 wt % hydrocarbon residue, wherein the sum of components in the emulsion does not exceed 100 wt %.

As a further embodiment, there is provided an oil-in-water emulsion according to any previous aspect, comprising from 20 to 30 wt % hydrocarbon residue, wherein the sum of components in the emulsion does not exceed 100 wt %.

As a further embodiment, there is provided an oil-in-water emulsion according to any previous aspect, wherein the glycerol is derived from a renewable carbon source.

"Renewable carbon source" or "Biomass" as used herein refers to an organic material carbon source which originates from plants, trees and crops. The term may include both carbon sources from dedicated energy crops, and from residues generated in the processing of crops for food or other products. Glycerol derived from a renewable carbon source may be produced from renewable, vegetable crops, such as rapeseed, canola, soybean or palm.

As a further embodiment, there is provided an oil-in-water emulsion according to any previous aspect, wherein the glycerol is present in the oil-phase.

As a further embodiment, there is provided an oil-in-water emulsion according to any preceding embodiment, wherein the glycerol is present in the aqueous-phase.

As a further embodiment, there is provided an oil-in-water emulsion according to any preceding embodiment, wherein the glycerol is present in both the oil-phase and the aqueous-phase.

As a further embodiment, there is provided an oil-in-water emulsion according to any preceding embodiment, wherein the oil-in-water emulsion comprises from 20 to 70 wt % glycerol, wherein the sum of components in the emulsion does not exceed 100 wt %.

As a further embodiment, there is provided an oil-in-water emulsion according to any preceding embodiment, wherein the oil-in-water emulsion comprises from 30 to 70 wt % glycerol, wherein the sum of components in the emulsion does not exceed 100 wt %.

As a further embodiment, there is provided an oil-in-water emulsion according to any preceding embodiment, wherein the oil-in-water emulsion comprises from 40 to 70 wt % glycerol, wherein the sum of components in the emulsion does not exceed 100 wt %.

As a further embodiment, there is provided an oil-in-water emulsion according to any preceding embodiment, wherein the oil-in-water emulsion comprises from 10 to 60 wt % glycerol, wherein the sum of components in the emulsion does not exceed 100 wt %. For example, the oil-in-water emulsion may comprise about 40, about 50 or about 60 wt % glycerol, wherein the sum of components in the emulsion does not exceed 100 wt %.

As a further embodiment, there is provided an oil-in-water emulsion according to any preceding embodiment, wherein the oil-in-water emulsion comprises from about 0.5 to about 70 wt % of an alcohol selected from the list consisting of $C_1$ to $C_{10}$ mono or di hydric alcohols, wherein the sum of components in the emulsion does not exceed 100 wt %.

For example, the oil-in-water emulsion may comprise from about 1 to about 60 wt %, from about 1 to about 50 wt %, from about 1 to about 40 wt %, from about 1 to about 30 wt %, or from about 1 to about 25 wt % of an alcohol selected from the list consisting of $C_1$ to $C_{10}$ mono or di hydric alcohols, wherein the sum of components in the emulsion does not exceed 100 wt %.

In some embodiments, the oil-in-water emulsion may comprise from about 2 to about 25 wt % of an alcohol selected from the list consisting of $C_1$ to $C_{10}$ mono or di hydric alcohols, wherein the sum of components in the emulsion does not exceed 100 wt %.

In some embodiments, the alcohol is selected from list consisting of methanol, ethanol, and butanol (for example 1-butanol, iso-butanol, sec-butanol, or tert-butanol). As a further embodiment, there is provided an oil-in-water emulsion according to any preceding embodiment, wherein the glycerol's contribution to the ash content of the fuel is less than 0.5 wt %

The ash content of the fuel is measured according to the method described in ASTM D 482-19 (Standard Test Method for Ash from Petroleum Products).

As a further embodiment, there is provided an oil-in-water emulsion according to any preceding embodiment, wherein the oil-in-water emulsion comprises one or more organic acids.

As a further embodiment, there is provided an oil-in-water emulsion according to any preceding embodiment, wherein the oil-in-water emulsion comprises one or more organic acids selected from methanesulfonic acid, formic acid, acetic acid, citric acid, benzoic acid, p-toluenesulfonic acid, and combinations thereof.

As a further embodiment, there is provided an oil-in-water emulsion according to any preceding embodiment, wherein the oil-in-water emulsion comprises one or more organic acids selected from methanesulfonic acid and formic acid.

As a further embodiment, there is provided an oil-in-water emulsion according to any preceding embodiment, wherein the emulsion and/or the aqueous phase has a pH of from 2 to 6.

As a further embodiment, there is provided an oil-in-water emulsion according to any preceding embodiment, wherein the emulsion and/or the aqueous phase has a pH from 2 to 4.5; or from 3 to 4.5.

As a further embodiment, there is provided an oil-in-water emulsion according to any preceding embodiment, wherein the oil-in-water emulsion further comprises a polymeric stabiliser.

As a further embodiment, there is provided an oil-in-water emulsion according to any preceding embodiment, wherein the oil-in-water emulsion further comprises a polymeric stabiliser selected from cationic polymers comprising at least one cationic monomer selected from the group consisting of dialkylaminoalkyl acrylate or dialkylaminoalkyl methacrylate quaternary salts such as dimethylaminoethyl acrylate methyl chloride quaternary salt, dimethylaminoethyl acrylate methyl sulfate quaternary salt, dimethylaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, or dialkylaminoalkylacrylamides or methacrylamides and their quaternary salts such as acrylamidopropyltrimethylammonium chloride, dimethylaminopropyl acrylamide methyl sulfate quaternary salt, dimethylaminopropyl acrylamide methyl saulfate quaternary salt, dimethylaminopropyl acrylamide sulfuric acid salt, dimethylaminopropyl acrylamide hydrochloride salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldimethylammonium chloride, and diallyldimethylammonium chloride, and combinations thereof.

As a further embodiment, there is provided an oil-in-water emulsion according to any preceding embodiment, wherein the oil-in-water emulsion further comprises one or more polymeric stabilisers, at least one of which is selected from the group consisting of alkyl hydroxyalkyl cellulose ethers, guar gum, starch and starch derivatives, hydroxyethyl cellulose and ethyl hydroxyl ethyl cellulose, and combinations thereof.

As a further embodiment, there is provided an oil-in-water emulsion according to any preceding embodiment, wherein the oil-in-water emulsion further comprises from 0.03 to 0.08 wt % polymeric stabilisers, wherein the sum of components in the emulsion does not exceed 100 wt %.

As a further embodiment there is provided an oil-in-water emulsion according to any preceding embodiment, comprising from 20 to 30 wt % hydrocarbon residue; and from 40 to 70 wt % glycerol, wherein the sum of components in the emulsion does not exceed 100 wt %.

As a further embodiment there is provided an oil-in-water emulsion according to any preceding embodiment, comprising from 40 to 60 wt % hydrocarbon residue; and from 20 to 60 wt % glycerol, wherein the sum of components in the emulsion does not exceed 100 wt %.

As a further embodiment there is provided an oil-in-water emulsion according to any preceding embodiment, comprising from about 40 to about 60 wt % hydrocarbon residue; from about 10 to 60 wt % glycerol, and from about 1 to about 30 wt % of an alcohol selected from the list consisting of $C_1$ to $C_{10}$ mono or di hydric alcohols, wherein the sum of components in the emulsion does not exceed 100 wt %. As a further embodiment, there is provided a fuel composition comprising or consisting of the oil-in-water emulsion of any preceding embodiment.

The fuel composition may be a diesel fuel.

The fuel composition may be a marine fuel.

The fuel composition may be a fuel oil for heat and power utility applications.

As a further embodiment, there is provided a process for preparing the oil-in-water emulsion fuel as defined in any preceding embodiment, the process comprising the steps of:

heating a hydrocarbon-containing oil and optionally glycerol to form the oil phase;

mixing water, the surfactant and optionally glycerol to form an aqueous solution; and blending the oil phase and the aqueous solution under conditions sufficient to form an oil-in-water emulsion;

wherein glycerol is present in the oil phase, or in the aqueous phase, or in the oil phase and the aqueous phase.

The use of glycerol in the oil-in-water emulsions of the present invention may have environmental and economic benefits. Advantages of the present invention may include an increased quantity of hydrocarbon residue derived from a renewable carbon source; increased density of the aqueous phase; improved lubricity; improved viscosity; decreased $CO_2$ from non-renewable sources for the same energy content; reduced sulfur emissions; and reduced water content.

As used herein, the term 'glycerol' refers to the compound propane-1,2,3-triol, also known as glycerine, or propanetriol. Glycerol may be derived from renewable or synthetic sources. Renewable sources include rapeseed, canola, soybean and palm. Glycerol may also be produced via the saponification process (soap production). Crude glycerol may be 60%-80% pure. Suitably, the glycerol used in the emulsions defined herein has 60% or greater purity; more preferably 70% or greater purity; more preferably 80% or greater purity; more preferably 90% or greater purity. More preferably the glycerol used in the emulsions defined herein is substantially pure or contains only minor impurities.

Parameter Measurement

The average droplet size distribution of the oil phase is measured using light scattering techniques using commercially and readily available apparatus, such as a Malvern Mastersizer™ instrument. The average droplet size is expressed as the Volume Moment Mean, represented as the D[4,3] mean. The average droplet size is suitably in the range of from 3 to 15 μm, although is preferably in the range of 5 to 10 μm.

Similar light scattering techniques and apparatus can be used to determine the droplet size distribution, and hence the weight %, of droplets with a size of greater than 125 μm based on the volume equivalent sphere diameter. Suitably, the percent of particles having a size of greater than 125 μm is less than 3 wt %. Preferably it is less than 2 wt %, and more preferably less than 1 wt %. In embodiments, less than 0.5 wt % can be achieved.

Dynamic viscosity is measured using standard techniques, and equipment such as the Malvern Kinexus™, which measures viscosity at controlled temperature and shear rates. The value is expressed in terms of mPas (cP), and is determined at a shear rate of 100 $s^{-1}$ and at 50° C. Suitably, the value is up to 500 mPas under such conditions, more preferably up to 300 mPas, more preferably from 50 to 300 mPas; more preferably from 100 to 300 mPas. The dynamic viscosity may be measured after manufacture of the oil-in-water emulsions or after storage. The oil-in-water emulsions provided herein exhibit dynamic stability of up to 500 mPas under the above conditions at at least one test point, e.g. after manufacture or after storage for 3 weeks at 50° C., and preferably both after manufacture and after storage for 3 weeks at 50° C. Preferably, the oil-in-water emulsions exhibit dynamic stability of up to 500 mPas at 50° C. and 100 $s^{-1}$ after manufacture or after storage for 3 weeks at 50° C.

Static stability is measured using the method defined in ASTM D6930-19 (Standard Test Method for Settlement and Storage Stability of Emulsified Asphalts).

The glycerol containing phase density is measured using any suitable method or apparatus, for example using an Anton Paar DMA 35 handheld density meter. For example, using the method defined in ISO 15212-1. Alternatively, the glycerol containing phase density can be calculated based on the components in the glycerol containing phase (for example using the density of the components and the volumetric contraction of the mixture).

Oil Phase

The oil phase of the emulsions comprises hydrocarbons. Typically, the oil is a source of heavy hydrocarbons, which may have a density slightly lower to significantly higher than water (e.g. 0.95 to 1.15 kg/$m^3$ or 0.95 to 1.25 kg/$m^3$ at 15° C.). The heavy hydrocarbon may have an extremely high viscosity. For example, the viscosity can be up to 300 000 cSt at 100° C. It can employ residues or hydrocarbon sources which have viscosities of 7 cSt or more at 25° C., or 10 cSt or more at 100° C. Hydrocarbon sources having viscosities of 180 cSt or more at 25° C., and preferably 250 cSt or more at 25° C., can also be utilised. The oil-phase hydrocarbons can be sourced from a number of established processes, including:

- processed natural heavy crude oil or natural bitumen (typically after de-sanding, de-salting, de-watering)
- refinery atmospheric distillation
- refinery vacuum distillation
- refinery visbreaking or thermal cracking or steam cracking
- refinery cat-cracking (thermal and catalytic)
- refinery hydroprocessing and hydrocracking
- de-asphalting processes.

In one embodiment the oil-in-water emulsion comprises an oil phase which is a hydrocarbon residue, e.g. being sourced from refinery residues with kinematic viscosities of up to 300 000 cSt at 100° C., and preferably above 200 cSt at 100° C., and more preferably above 1 000 cSt at 100° C. Examples of suitable hydrocarbon residues that can be used in the oil-in-water emulsion of the present invention are given in Table 1.

TABLE 1

Examples of hydrocarbon residues

| Residue Type | CAS RN | Description |
|---|---|---|
| Asphalt | 8052-42-4 | Combination of high molecular weight oil derived compounds with high proportion of carbon numbers >C25. |
| Residue (petroleum), atm. Tower | 64741-45-3 | A residue produced from the atmospheric distillation of crude oil. Combination of high molecular weight oil derived compounds with high proportion of carbon numbers >C20, and boiling at >350° C. (662° F.). |
| Residue (petroleum), vacuum | 64741-56-6 | A residue produced from the vacuum distillation of residue coming from the atmospheric distillation of crude oil. Combination of high molecular weight oil derived compounds with high proportion of carbon numbers >C34, and boiling at >495° C. (923° F.). |
| Residue (petroleum), catalytic reformer fractionator | 64741-67-9 | A residue produced from the distillation of product derived from a catalytic reformer process. Combination of high molecular weight oil derived compounds with high proportion of carbon numbers C10-C25, and boiling range 160-400° C. (320-725° F.). |
| Residue (petroleum), hydrocracker | 64741-75-9 | A residue produced from the distillation of product derived from a hydrocracking process. Combination of high molecular weight oil derived compounds with high proportion of carbon numbers >C20, and boiling >350° C. (662° F.). |
| Residue (petroleum), thermal cracked | 64741-80-6 | A residue produced from the distillation of product derived from a thermal cracking process. Combination of high molecular weight oil derived compounds with high proportion of carbon numbers >C20, and boiling >350° C. (662° F.). |
| Raffinates (petroleum), residual oil decarbonation | 64742-07-0 | Combination of hydrocarbons obtained as the solvent insoluble fraction from C5-C7 solvent decarbonisation of a residue with high proportion of carbon numbers >C34, and boiling >495° C. (923° F.). |
| Residue (petroleum), hydrodesulphurised atmospheric | 64742-78-5 | A residue produced from treating an atmospheric tower residue with hydrogen (in the presence of a catalyst), primarily to remove sulphur. Combination of high molecular weight oil derived compounds with high proportion of carbon numbers >C20, and boiling >350° C. (662° F.). |

TABLE 1-continued

| Examples of hydrocarbon residues | | |
|---|---|---|
| Residue Type | CAS RN | Description |
| Residue (petroleum), hydrodesulphurised atmospheric | 64742-85-4 | A residue produced from treating an vacuum tower residue with hydrogen (in the presence of a catalyst), primarily to remove sulphur. Combination of high molecular weight oil derived compounds with high proportion of carbon numbers >C34, and boiling >495° C. (923° F.). |
| Residue (petroleum), catalytic reformer fractionator residual distillation | 68748-13-7 | A residue produced from the distillation of catalytic reformer process residue. Combination of high molecular weight oil derived compounds with that boil >399° C. (750° F.). |
| Residue (petroleum), coker scrubber condensed ring aromatic containing | 68783-13-1 | Combination of hydrocarbons obtained as the residual fraction from the distillation of vacuum residue and the products from a thermal cracking process, with high proportion of carbon numbers >C20, and boiling >350° C. (662° F.). |
| Residue (petroleum), solvent extracted vacuum distilled atmospheric residue | 70913-85-8 | A residue produced by the solvent extraction of a vacuum distillate of a residue from the atmospheric distillation of crude oil |
| Asphaltenes (petroleum), | 91995-23-2 | Combination of hydrocarbons obtained as a complex solid black product by the separation of petroleum residue by means of a special treatment of a light hydrocarbon cut. The carbon/hydrogen ratio is especially high. |
| Residue (petroleum), thermally cracked vacuum | 92062-05-0 | Combination of hydrocarbons obtained from the vacuum distillation of the products from a thermal cracking process, with high proportion of carbon numbers >C34, and boiling >495° C. (923° F.). |

An example hydrocarbon residue that can be used is given in Table 2.

TABLE 2

| Example of hydrocarbon residue | |
|---|---|
| Property | Typical VDU, visbreaker or vacuum flashed visbreaker residue. |
| Viscosity, cSt | max. 150,000 at 100° C. |
| Density g/ml | max. 1.08 at 15° C. |
| Sulphur, % wt. | max. 3.5 |
| Al/Si content, ppm | max. 10 |
| P-value (if applicable) | min. 1.05 |
| Filterable solids | None |

In some embodiments, oil-in-water emulsions according to the invention can typically contain 20 wt % or more of the "oil" phase, e.g. the hydrocarbon residue. In some embodiments, the emulsion may comprise up to 70 wt % of the oil phase. In some embodiments, the emulsion may comprise in the range of from 20 to 30 wt % of the oil phase.

Aqueous Phase

The water in the aqueous phase can come from a variety of sources. An example of a water specification that can be used is given in Table 3.

TABLE 3

| Example of water specification for oil-in-water emulsion production | |
|---|---|
| Parameter | Value |
| Suspended solids | Less than 10 mg/l and Filtered to 35 μm |
| Chlorides, mg/l | Less than 50 |
| Alkali metals, mg/l | Less than 20 |
| Alkaline earth metals, mg/l | Less than 30 |
| Silicon as $SiO_2$, mg/l | Less than 40 |

TABLE 3-continued

| Example of water specification for oil-in-water emulsion production | |
|---|---|
| Parameter | Value |
| pH | 6.5 to 8 |
| Total hardness | Max 6°dH |

Optionally, the water can be pretreated, for example by filtration and/or deionization. In some embodiment, the water content of the oil-in-water emulsions of the present invention may be from trace amounts to 40 wt %, typically in the range of from 5 to 30 wt %. Preferably the water content is in the range of from 5 to 15 wt %.

Chemical Additives

The oil-in-water emulsion of the present invention comprises a surfactant and glycerol. In some embodiments the oil-in-water emulsion may additionally comprise one or more organic acids. In some embodiments the oil-in-water emulsion may additionally comprise a polymeric stabiliser. In some embodiments, the oil-in-water emulsion may additionally comprise an alcohol selected from the list consisting of $C_1$ to $C_{10}$ mono or di hydric alcohols.

The chemical additives are typically added to the aqueous phase before mixing with the oil phase when preparing the oil-in-water emulsion. The glycerol may be added to the oil phase or the aqueous phase, or both. The $C_1$ to $C_{10}$ mono or di hydric alcohol may be added to the oil phase or the aqueous phase, or both.

The chemical additives can be provided separately, or two or more additives can be provided in the form of a pre-prepared chemical additive package.

Surfactants

The oil-in-water emulsion of the invention comprises at least one surfactant, which is typically added to the aqueous phase before being mixed with the oil phase when preparing the oil-in-water emulsion. In some embodiment, in which glycerol is present in the oil phase, the surfactant may also be added to the oil phase.

The surfactant is present in an amount ranging from 0.05 to 0.6% wt of the oil-in-water emulsion. The aim of the surfactant is to act as an emulsifier, to stabilise the oil phase droplets in the aqueous phase. A range of from 0.05 to 0.5 wt % surfactant may be used, for example 0.08 to 0.4 wt %.

A number of surfactants can be employed. There can be one surfactant or a combination of more than one surfactant. At least one surfactant, optionally all the surfactants, may be selected from one or more of the following:

fatty alkyl amines according to the formula;

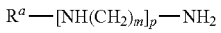

where;

$R^a$ is an aliphatic group having 12 to 24 carbon atoms (preferably 12-14, 14-16, 16-18, 18-20, 20-22 or 22-24 carbon atoms)

m is a number 2 or 3 p is a number 0 to 3 ethoxylated fatty alkyl amines according to the formula;

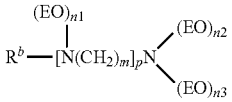

where;

$R^b$ is an aliphatic group having from 12 to 24 carbon atoms (preferably 12-14, 14-16, 16-18, 18-20, 20-22 or 22-24 carbon atoms)

m is a number 2 or 3 p is a number 1 to 3 n1, n2 and n3 are each independently a number within the range greater than 0 to 70, for example from 2 to 70, or from 3 to 70. In one embodiment, n1+n2+n3 is a number greater than 0 and up to 210. Each of n1, n2 and n3 may or may not be an integer.

ethoxylated fatty alkyl monoamines according to the formula;

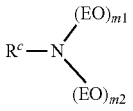

where;

$R^c$ is an aliphatic group having from 12 to 24 carbon atoms (preferably 12-14, 14-16, 16-18, 18-20, 20-22 or 22-24 carbon atoms)

m1 and m2 are each a number within the range greater than 0 and up to 70, for example from 2 to 70, or from 3 to 70. In one embodiment, m1+m2 is a number greater than 0 and up to 140. Each of m1 and m2 may or may not be an integer.

methylated fatty alkyl monoamines according to the formula;

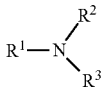

where;

one or two of the groups $R^1$, $R^2$, and $R^3$ are each independently selected from aliphatic groups having from 8 to 22 carbon atoms (preferably 8-10, 10-12, 12-14, 14-16, 16-18, 18-20 or 20-22 carbon atoms)

the remaining groups of $R^1$, $R^2$, and $R^3$ are methyl;

methylated fatty alkyl amines according to the formula;

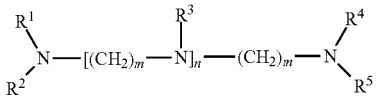

where;

one or two of the groups $R^1$ to $R^5$ are independently selected from aliphatic groups having from 8 to 22 carbon atoms (preferably 8-10, 10-12, 12-14, 14-16, 16-18, 18-20 or 20-22 carbon atoms)

the remaining groups of $R^1$ to $R^5$ are methyl n is an integer from 1 to 5 m is 2 or 3, or according to the formula;

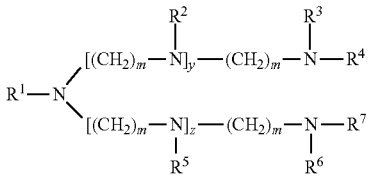

where;

one or two of the groups $R^1$ to $R^7$ are each selected from aliphatic groups having from 8 to 22 carbon atoms (preferably 8-10, 10-12, 12-14, 14-16, 16-18, 18-20 or 20-22 carbon atoms)

the remaining groups of $R^1$ to $R^7$ are methyl m is 2 or 3 y and z are integers from 0 to 4, and (y+z) is 0 to 4;

or according to the formula;

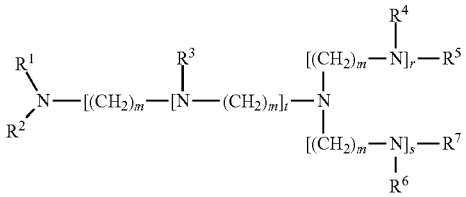

where;

one or two of the groups $R^1$ to $R^7$ are an aliphatic group containing 8 to 22 carbon atoms (preferably 8-10, 10-12, 12-14, 14-16, 16-18, 18-20 or 20-22 carbon atoms)

the remaining groups of $R^1$ to $R^7$ are methyl m is 2 or 3 t is between 0 to 3 r and s are between 1 to 4, and (t+r+s) is between 2 to 5; and;

quaternary fatty alkyl amines according to the formula;

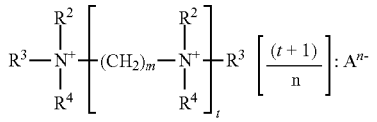

where;

$R_1$ is an aliphatic group having 12 to 24 carbon atoms (preferably 12-14, 14-16, 16-18, 18-20, 20-22, or 22-24 carbon atoms), e.g. —$(CH_2)_y$—$CH_3$, optionally comprising a carbonyl group adjacent to the nitrogen atom, i.e. —C(O)—$(CH_2)_{(y-1)}$—$CH_3$, where y is from 10 to 22 (preferably y is 10-12, 12-14, 14-16, 16-18, 18-20 or 20-22);

$R^2$ and $R^3$ are independently at each occurrence selected from H or an aliphatic group having from 1 to 6 carbon atoms, preferably from 1 to 3 carbon atoms, and more preferably 1 carbon atom;

$R^4$ is selected from H or a $C_{14}$ aliphatic group;

m is 2 or 3;

t is from 0 to 4

A is an anion;

n is the valence of the anion.

The aliphatic groups mentioned in the formulae above, including those containing a carbonyl group, can optionally be substituted, typically with one or more, for example from 1 to 3, substituents which are independently selected from hydroxyl, $C_{1-3}$ alkyl, $C_{1-3}$ alkoxy, or $C_{1-3}$ hydroxyalkyl. Preferably, there are no substituents on the aliphatic groups. Each aliphatic group can be saturated, or can comprise double or triple carbon-carbon bonds, for example up to 6 double bonds, for example up to 3 double bonds.

Preferably, $R^1$ has a formula $C_{14-20}H_{24-41}$, or $C(O)C_{13-19}H_{22-39}$. More preferably it has a formula $C_{14-20}H_{24-41}$.

Preferably, each $R^2$ and $R^3$ is independently selected from $CH_3$, H and $CH_2CH_2OH$.

Preferably, each $R^4$ is independently selected from $CH_3$ and H.

Examples of fatty alkyl amines include:

quaternary fatty alkyl monoamines according to the formula;

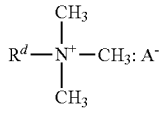

where;

$R^d$ is an aliphatic group having 12 to 24 carbon atoms (preferably 12-14, 14-16, 16-18, 18-20, 20-22, or 22-24 carbon atoms)

A is an anion;

and quaternary fatty alkyl diamines according to the formula;

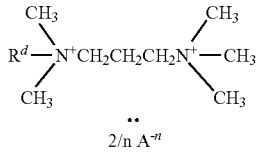

where;

$R^d$ is an aliphatic group having 12 to 24 carbon atoms (preferably 12-14, 14-16, 16-18, 18-20, 20-22, or 22-24 carbon atoms)

A is an anion n is the valence of the anion.

In the above, the anion A is preferably selected from those anions which bind more strongly to the quaternary amine than carbonate. Examples include halide, particularly $Cl^-$, and organic anions such as formate ($HCOO^-$), acetate ($CH_3COO^-$) and methane sulfonate ($CH_3SO_3^-$).

In the above, the group "EO" is an ethoxylate group (—$CH_2CH_2O$—). The ethoxylate group (or polyether group for more than one linked ethoxylate group) is typically terminated by H, i.e. —$CH_2CH_2OH$.

In embodiments, the surfactant is selected from one or more fatty alkyl di-, tri- and tetra-amines, ethoxylated fatty alkyl mono-, di- and tri-amines, and quaternary fatty alkyl amines.

In further embodiments, the surfactant is selected from one or more fatty alkyl diamines, fatty alkyl tetra-amines, ethoxylated fatty alkyl diamines, and quaternary fatty alkyl amines. Examples include fatty alkyl tripropylenetetramine, such as tallow tripropylenetetramine, fatty alkyl propylene diamines, oleyldiamine ethoxylate.

The term "fatty alkyl" includes not only saturated groups (i.e. $C_{12}$ to $C_{24}$ alkyl groups, preferably $C_{12-14}$, $C_{14-16}$, $C_{16-18}$, $C_{18-20}$, $C_{20-22}$ or $C_{22-24}$), but also partially unsaturated $C_{12}$ to $C_{24}$ groups (i.e. $C_{12}$ to $C_{24}$ alkenyl groups, preferably $C_{12-14}$, $C_{14-16}$, $C_{16-18}$, $C_{18-20}$, $C_{20-22}$ or $C_{22-24}$), for example having up to six C=C double bonds. Preferred fatty alkyl groups have no more than 3 double bonds. Examples of fatty alkyl groups include oleyl (C18, 1 double bond), and other groups associated with tallow, e.g. palmityl (C16, 0 double bonds), stearyl (C18, no double bonds), myristyl (C14, no double bonds), palmitoleyl (C16, 1 double bond), linoleyl (C18, 2 double bonds) and linolenyl (C18, 3 double bonds). The term "fatty alkyl" includes both natural and synthetic alkyl groups, for example synthetic alkyl groups may comprise $C_{15}$ or $C_{17}$. Examples of suitable fatty alkyl groups include $C_{12}$, $C_{13}$, $C_{14}$, $C_{15}$, $C_{16}$, $C_{17}$ and $C_{18}$ groups, each of which may be fully saturated or may comprise one or more double bonds.

The surfactant may be selected based on the composition of the aqueous phase, the oil phase and/or the oil-in-water emulsion as a whole. For example, the surfactant may be selected to ensure that the components of the aqueous phase or oil phase are soluble with each other. For example, the surfactant may be selected to ensure that the components of the phase containing the $C_1$ to $C_{10}$ mono or di hydric alcohol are soluble with each other.

Alcohol

In some embodiments, an alcohol selected from the list consisting of $C_1$ to $C_{10}$ mono or di hydric alcohols may be included in the oil-in-water emulsion. For example, the alcohol may be comprised in the oil phase and/or the aqueous phase. For example, the alcohol may be comprised in the aqueous phase. For example, the alcohol may be comprised in the oil phase. For example, the alcohol may be comprised in the oil phase and the aqueous phase Preferably, the alcohol is comprised in the aqueous phase.

In some embodiments, the alcohol is comprised in the glycerol containing phase (i.e. the glycerol containing phase contains the alcohol). The glycerol containing phase is the phase (e.g. the oil phase or aqueous phase) that contains the glycerol.

It has been found that when an alcohol selected from the list consisting of $C_1$ to $C_{10}$ mono or di hydric alcohols is comprised in the oil-in-water emulsion (for example in the glycerol containing phase), it is possible to obtain a glycerol containing phase that has a particularly favourable density. For example, it is possible to obtain a glycerol containing phase that has a density that is about +/−0.05 g/mL (for example +/−0.05 g/mL) of a hydrocarbon residue. It has been found that such a glycerol containing phase results in the oil-in-water emulsion having an increased stability (for example to creaming or sedimentation).

When the term +/−0.05 g/mL is used it means that the density of the glycerol containing phase has value of +0.05 g/mL that of the density of the hydrocarbon residue or −0.05 g/mL that of the hydrocarbon residue. It does not mean that the glycerol containing phase has value within +/−0.05 g/mL of the hydrocarbon residue.

In a preferred embodiment, the oil-in-water emulsion comprises a hydrocarbon residue and the glycerol containing phase has a density of from +0.05 g/mL to about +0.5 g/mL or from −0.05 g/mL to about −0.5 g/mL of the hydrocarbon residue. For example, the glycerol containing phase may have a density of from +0.05 g/mL to about +0.46 g/mL or from −0.05 g/mL to about −0.46 g/mL of the hydrocarbon residue. For example, the glycerol containing phase may have a density of from +0.05 g/mL to about +0.3 g/mL or from −0.05 g/mL to about −0.3 g/mL of the hydrocarbon residue. For example, the glycerol containing phase may have a density of from +0.05 g/mL to about +0.2 g/mL or from −0.05 g/mL to about −0.2 g/mL of the hydrocarbon residue. For example, the glycerol containing phase may have a density of from +0.05 g/mL to about +0.1 g/mL or from −0.05 g/mL to about −0.1 g/mL of the hydrocarbon residue. For example, the glycerol containing phase may have a density of from +0.05 g/mL to about +0.08 g/mL or from −0.05 g/mL to about −0.08 g/mL of the hydrocarbon residue. In these embodiments, the density is measured at storage temperature.

In a preferred embodiment, the oil-in-water emulsion comprises a hydrocarbon residue and the glycerol containing phase has a density of from +0.05 g/mL to about +0.5 g/mL of the hydrocarbon residue. For example, the glycerol containing phase may have a density of from +0.05 g/mL to about +0.46 g/mL of the hydrocarbon residue. For example, the glycerol containing phase may have a density of from +0.05 g/mL to about +0.3 g/mL of the hydrocarbon residue. For example, the glycerol containing phase may have a density of from +0.05 g/mL to about +0.2 g/mL of the hydrocarbon residue. For example, the glycerol containing phase may have a density of from +0.05 g/mL to about +0.1 g/mL of the hydrocarbon residue. For example, the glycerol containing phase may have a density of from +0.05 g/mL to about +0.08 g/mL of the hydrocarbon residue. In these embodiments, the density is measured at storage temperature.

In a preferred embodiment, the oil-in-water emulsion comprises a hydrocarbon residue and the glycerol containing phase has a density of from −0.05 g/mL to about −0.5 g/mL of the hydrocarbon residue. For example, the glycerol containing phase may have a density of from −0.05 g/mL to about −0.46 g/mL of the hydrocarbon residue. For example, the glycerol containing phase may have a density of from −0.05 g/mL to about −0.3 g/mL of the hydrocarbon residue. For example, the glycerol containing phase may have a density of from −0.05 g/mL to about −0.2 g/mL of the hydrocarbon residue. For example, the glycerol containing phase may have a density of from −0.05 g/mL to about −0.1 g/mL of the hydrocarbon residue. For example, the glycerol containing phase may have a density of from −0.05 g/mL to about −0.08 g/mL of the hydrocarbon residue. In these embodiments, the density is measured at storage temperature.

The storage temperature is between 20 and 40° C. Preferably, the storage temperature is 30° C.

The oil-in-water emulsion according to any preceding embodiment may comprise from about 0.5 to about 70 wt % of an alcohol selected from the list consisting of $C_1$ to $C_{10}$ mono or di hydric alcohols, wherein the sum of components in the emulsion does not exceed 100 wt %. For example, the oil-in-water emulsion may comprise from about 1 to about 60 wt %, from about 1 to about 50 wt %, from about 1 to about 40 wt %, from about 1 to about 30 wt %, or from about 1 to about 25 wt % of an alcohol selected from the list consisting of $C_1$ to $C_{10}$ mono or di hydric alcohols, wherein the sum of components in the emulsion does not exceed 100 wt %. In some embodiments, the oil-in-water emulsion may comprise from about 2 to about 25 wt % of an alcohol selected from the list consisting of $C_1$ to $C_{10}$ mono or di hydric alcohols, wherein the sum of components in the emulsion does not exceed 100 wt %.

For example, the oil-in-water emulsion may comprise about 2, about 10, about 15, about 20, or about 25 wt. % of an alcohol selected from the list consisting of $C_1$ to $C_{10}$ mono or di hydric alcohols, wherein the sum of components in the emulsion does not exceed 100 wt %.

In some embodiments, the $C_1$ to $C_{10}$ mono or di hydric alcohol is a linear or branched $C_1$ to $C_{10}$ mono or di hydric alcohol. In some embodiments, the alcohol is selected from the list consisting of $C_1$ to $C_6$ mono or di hydric alcohols. In some embodiments, the $C_1$ to $C_6$ mono or di hydric alcohol is a linear or branched $C_1$ to $C_6$ mono or di hydric alcohol. In some embodiments, the alcohol is selected from the list consisting of $C_1$ to $C_4$ mono or di hydric alcohols. In some embodiments, the $C_1$ to $C_4$ mono or di hydric alcohol is a linear or branched $C_1$ to $C_4$ mono or di hydric alcohol.

In some embodiments, the alcohol is selected from the list consisting of $C_1$ to $C_{10}$ mono hydric alcohols, $C_1$ to $C_6$ mono hydric alcohols, or $C_1$ to $C_4$ mono hydric alcohols. The $C_1$ to $C_4$ mono hydric alcohol may be methanol, ethanol, propanol, or butanol. For example, the di hydric alcohol may be ethylene glycol. For example, the alcohol may be selected from methanol, ethanol, or butanol (for example 1-butanol, iso-butanol, sec-butanol, or tert-butanol).

In some embodiments, the $C_1$ to $C_{10}$ mono or di hydric alcohol may refer to two or more (for example two, three or four) alcohols each individually selected from the list consisting of $C_1$ to $C_{10}$ mono or di hydric alcohols.

In some embodiments, the oil-in-water emulsion according to any embodiment described herein may comprise from about 0.5 to about 70 wt % of a second alcohol individually selected from the list consisting of $C_1$ to $C_{10}$ mono or di hydric alcohols provided that the sum of $C_1$ to $C_{10}$ mono or di hydric alcohols in the oil-in-water emulsion is from about 1 to about 70 wt % and the sum of components in the emulsion does not exceed 100 wt %. For example, the oil-in-water emulsion may comprise a first alcohol (for example methanol) and a second alcohol (for example ethanol) provided that the sum of the $C_1$ to $C_{10}$ mono or di hydric alcohols in the oil-in-water emulsion is from about 1 to about 70 wt % and the sum of components in the emulsion does not exceed 100 wt %.

In some embodiments, the ratio of glycerol:alcohol in the glycerol containing phase is from about 20:1 to about 1:5, for example, from about 38:2 to about 1.5:2.5. In some embodiments, the ratio of glycerol:alcohol in the glycerol containing phase is about 38:2, about 3:10; about 2.5:1.5; about 2:2, or about 1.5:2.5.

In some embodiments, glycerol containing phase has a density of between 0.8 g/mL and about 1.3 g/mL (measured at 25° C. and using the method described in ISO 15212-1).

Polymeric Stabiliser

In some embodiments, one or more polymeric stabilisers may be added to the aqueous phase when preparing the oil-in-water emulsions. They are preferably included in amounts of up to 0.25 wt % of the oil-in-water emulsion. In embodiments, they are present in amounts in the range of from 0.01 to 0.10 wt %.

Polymeric stabilising and flow improvement agents may be used to improve static stability in storage by compensating for the density differential between the residue and aqueous phase. They can also modify the viscosity characteristics of the emulsion.

The polymer stabilising additive can form a weakly 'gelled' structure in the aqueous additive-containing phase, which helps to improve static stability of the oil-in-water emulsion by holding the hydrocarbon residue droplets apart, preventing sedimentation during static storage conditions. The weak gel structure can also impart low resistance or yield to applied stress to ensure suitable low viscosity characteristics of the emulsion, for example during pumping and handling. This behaviour can also be recoverable, for example once the oil-in-water emulsion fuel is pumped into a tank it can recover its static stability characteristics. The polymer additive can help to achieve this by interacting with the other additives in the formulation through entanglement and bonding mechanisms, forming a molecularly structured gel.

There can be one or more than one polymeric stabiliser and flow improving agent. At least one polymeric stabiliser and flow improving agent is selected from polymers containing monomers comprising dialkylaminoalkyl acrylate or dialkylaminoalkyl methacrylate quaternary salts, or dialkylaminoalkylacrylamides or methacrylamides and their quaternary salts.

Examples of such polymeric stabilisers and flow improving agents include cationic polymers comprising at least one cationic monomer selected from the group of dialkylaminoalkyl acrylate or dialkylaminoalkyl methacrylate quaternary salts such as dimethylaminoethyl acrylate methyl chloride quaternary salt, dimethylaminoethyl acrylate methyl sulfate quaternary salt, dimethylaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, or dialkylaminoalkylacrylamides or methacrylamides and their quaternary salts such as acrylamidopropyltrimethylammonium chloride, dimethylaminopropyl acrylamide methyl sulfate quaternary salt, dimethylaminopropyl acrylamide methyl saulfate quaternary salt, dimethylaminopropyl acrylamide sulfuric acid salt, dimethylaminopropyl acrylamide hydrochloride salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldimethylammonium chloride, and diallyldimethylammonium chloride.

Additional polymeric stabilisers and flow improving agents may be selected from one or more alkyl hydroxyalkyl cellulose ethers (water soluble), preferably having an alkyl group with 1 to 3 carbon atoms, and an hydroxyalkyl group (e.g., hydroxyethyl or hydroxypropyl), where;

$DS_{alkyl}$ is in the range of from 0.1 to 2.5;

$MS_{hydroxyalkyl}$ is in the range of from 0.2 to 4.0;

weight average molecular weight is in the range of from 100,000 to 2,000,000 Da (ideally from 800,000 to 1,600,000 Da).

Examples include methyl ethyl hydroxyethyl cellulose ether (water soluble), preferably having $DS_{methyl}$ in the range of from 0.3 to 1.5

$DS_{ethyl}$ in the range of from 0.1 to 0.7

$MS_{hydroxyethyl}$ in the range of from 0.2 to 3.0.

DS represents the degree of substitution of the specified component, and MS represents the extent of molar substitution of the specified component.

Further examples of additional polymeric stabilisers include those where (in the formula represented below) R is H, $CH_3$ and/or $[CH_2CH_2O]_nH$.

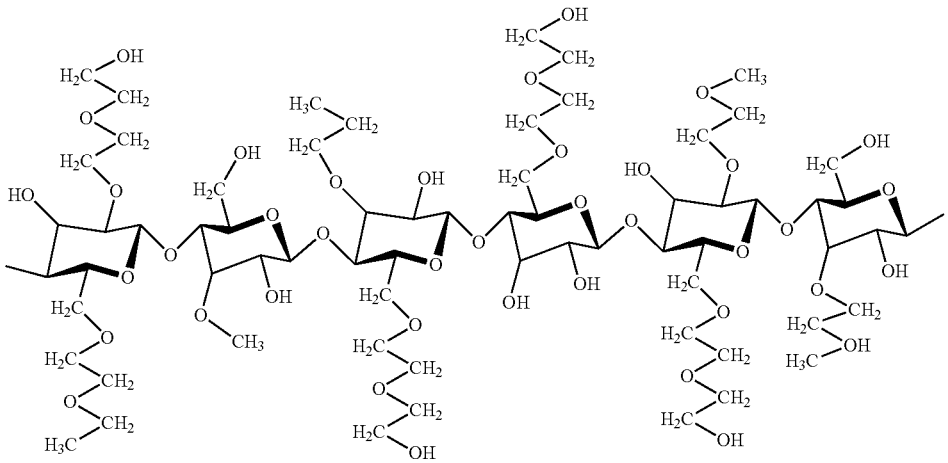

Other examples of additional polymeric stabiliser and flow improvement agent can include guar gum, starch and starch derivatives, hydroxy ethyl cellulose, and ethyl hydroxy ethyl cellulose.

Acid

An acid, i.e. a Brønsted acid, may be used to activate the surfactant. In some embodiments, the oil-in-water emulsions and/or the aqueous phase have a pH of 2 to 6, and more preferably in the range 2 to 4.5, or 3 to 4.5.

The oil-in-water emulsions may comprise one or more organic acids. Organic acids comprise at least one C—H bond, examples of which include methanesulfonic acid, formic acid, acetic acid, citric acid, para-toluene sulfonic acid, and benzoic acid.

At least one of the organic acids (optionally all) is preferably selected from methanesulfonic acid, formic acid, acetic acid, citric acid, benzoic acid, and para-toluene sulfonic acid. Preferably at least one (optionally all) of the acids are selected from formic acid and methanesulfonic acid.

Oil-In-Water Emulsions as Fuels

In some embodiments, an oil-in-water emulsion fuel according to the invention comprises one, more than one, or all of the characteristics defined in Table 4.

TABLE 4

An embodiment of an oil-in-water emulsion suitable for use as a fuel

| Component | Typical Range (wt %)* |
|---|---|
| Hydrocarbon Residue | 20-70 |
| Water | Trace to –40 |
| Surfactant | 0.05 to 0.6 |
| Glycerol | 0.5 to 70 |
| Polymeric stabiliser | 0 to 0.25 |
| TOTAL wt % | 100 wt % |

*wherein for each emulsion, the total equals 100 wt %

For the avoidance of doubt, the term 'wt %' as used herein refers to the weight % of active component. For example, where the component is the surfactant, the term wt % refers to the wt % of the active surfactant. Furthermore, where ranges are given for each ingredient or active component, the sum of ingredients in the emulsion does not exceed 100 wt %. For example, in an oil-in-water emulsion where 70 wt % hydrocarbon residue is used, a smaller proportion of the glycerol component will be used, so that the maximum 100 wt % is not exceeded. In an oil-in-water emulsion where the higher quantity of 70 wt % glycerol is used, a smaller proportion of hydrocarbon residue will be used.

In some embodiments, the oil-in-water emulsion may comprise up to 70 wt % glycerol, up to 30 wt % hydrocarbon residue, and only trace amounts of water. In such embodiments, the glycerol acts as an equivalent to the water in the aqueous phase.

In some embodiments the oil-in-water emulsion set out in Table 4 may additionally comprise one or more organic acids in an amount sufficient to achieve a pH of the emulsion and/or of the aqueous phase in the range 2 to 6, preferably in the range 2 to 4.5, or 3 to 4.5.

Preparation of an Oil-in-Water Emulsion. The oil-in-water emulsion can be prepared by a process in which water and the one or more chemical additives are mixed to form the aqueous phase; heating a hydrocarbon-containing oil and optionally glycerol; and blending the hydrocarbon-containing oil and the aqueous phase to form an oil-in-water emulsion.

It is preferred that the chemical additives form an aqueous solution when mixed with water, although a suspension or emulsion can be tolerated provided there is sufficient mixing with the hydrocarbon oil-containing phase to ensure a stable oil-in-water emulsion results.

Examples of the hydrocarbon-containing oil are provided above. It is preferably heated to a temperature sufficient to reduce its viscosity to below 500 cSt, for example in the range of from 100 to 500 cSt or 200 to 500 cSt.

Preferably, it is heated to a temperature such that, when mixing with the aqueous phase, the resulting temperature at the oil-water interface will be such that the viscosity of the oil phase is less than 10000 cSt. This will depend on the heat capacities of the aqueous phase (which incorporates the chemical additives) and the hydrocarbon-containing oil, and also their relative concentrations.

The relationship between the temperature at the interface and the initial temperatures of the aqueous and oil phases can be expressed by the following equation:

$$T_{aq} = T_i + \left\{(T_i - T_{oil}) \times \left(\frac{C_{oil}}{C_{aq}}\right) \times \left(\frac{[\text{oil}]}{[aq]}\right)\right\}$$

In the above equation:

$T_i$=temperature at the oil/water interface of the oil-in-water emulsion $T_{oil}$=temperature of oil phase before mixing (° C.)

$T_{aq}$=temperature of aqueous phase before mixing (° C.)

$C_{oil}$=specific heat capacity of oil phase (kJ/kg/° C.)

$C_{aq}$=specific heat capacity of aqueous phase (kJ/kg/° C.)

[oil]=proportion of oil phase (wt %)

[aq]=proportion of aqueous phase (wt %)

The temperature of the oil phase ($T_{oil}$) before mixing is preferably such that the hydrocarbon-containing oil viscosity is in the range of from 200-500 cSt. Although this is dependent on the source of hydrocarbons, it is typically in a range of from 110 to 230° C.

The temperature at the oil/water interface after mixing ($T_i$) is preferably such that the viscosity of the hydrocarbon-containing oil is less than 10 000 cSt. This temperature is preferably less than the boiling point of the aqueous phase, and also a temperature at which the thermal and phase stability of the chemical additives is preserved. Typically, this temperature is in the range of from 70 to 150° C., for example from 80 to 120° C.

The temperature of the aqueous phase before mixing ($T_{aq}$) is selected according to the above requirements of the $T_i$ and $T_{oil}$ temperatures. Typically, it is in the range of from 30 to 95° C., for example from 50 to 90° C., or 50 to 70° C.

Mixing to form the emulsion can be achieved using apparatus and technology known to a skilled person, such as high shear mixing apparatus.

In one embodiment, two separate and different emulsions are separately prepared and mixed to form a composite oil-in-water emulsion, which enables further control over the properties of the desired oil-in-water emulsion to be achieved.

Figure 2:
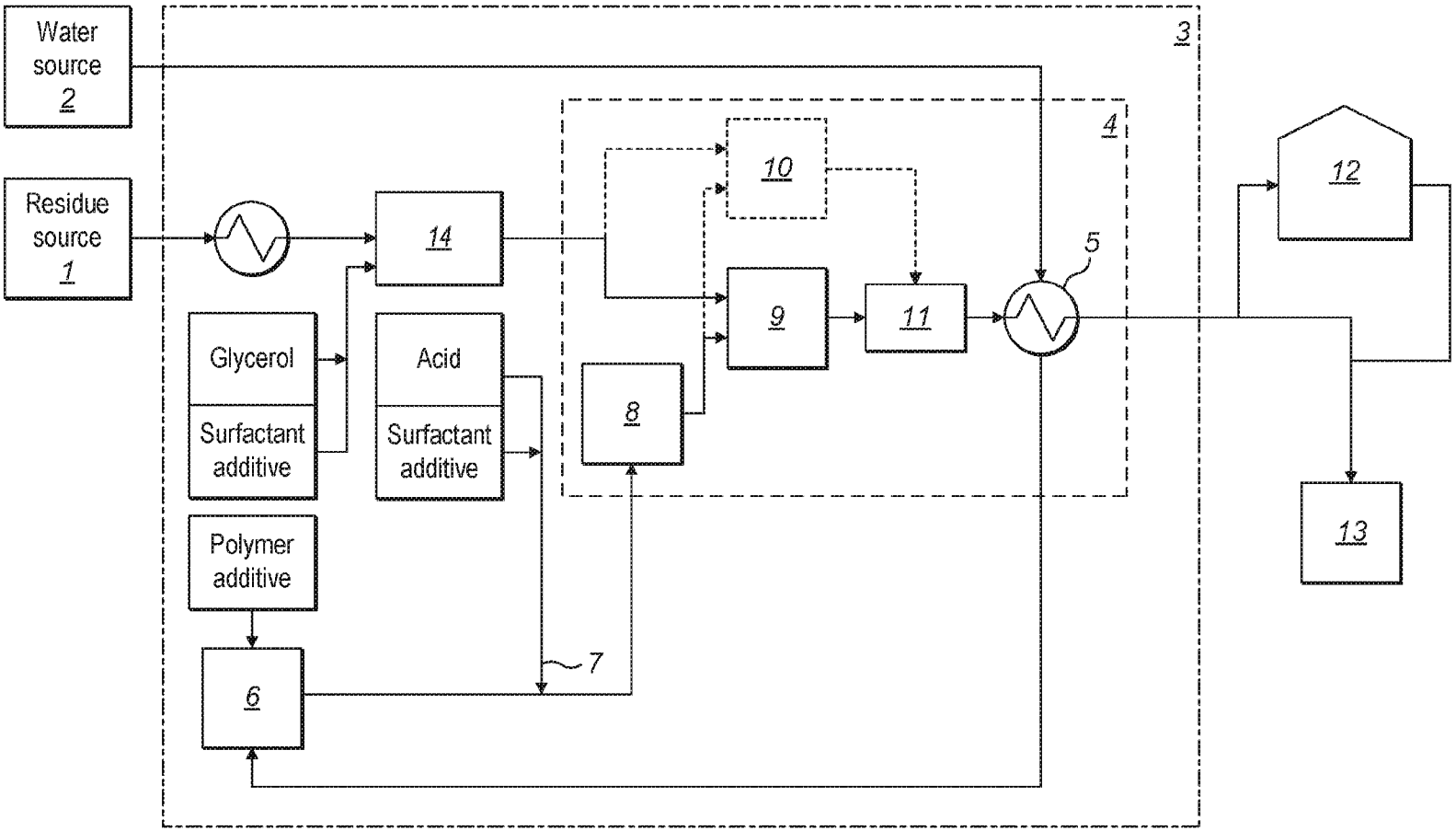
FIG. 2 shows a schematic of a process for producing an oil-in-water emulsion wherein glycerol is present in the oil phase, as described herein.
Figure 3:
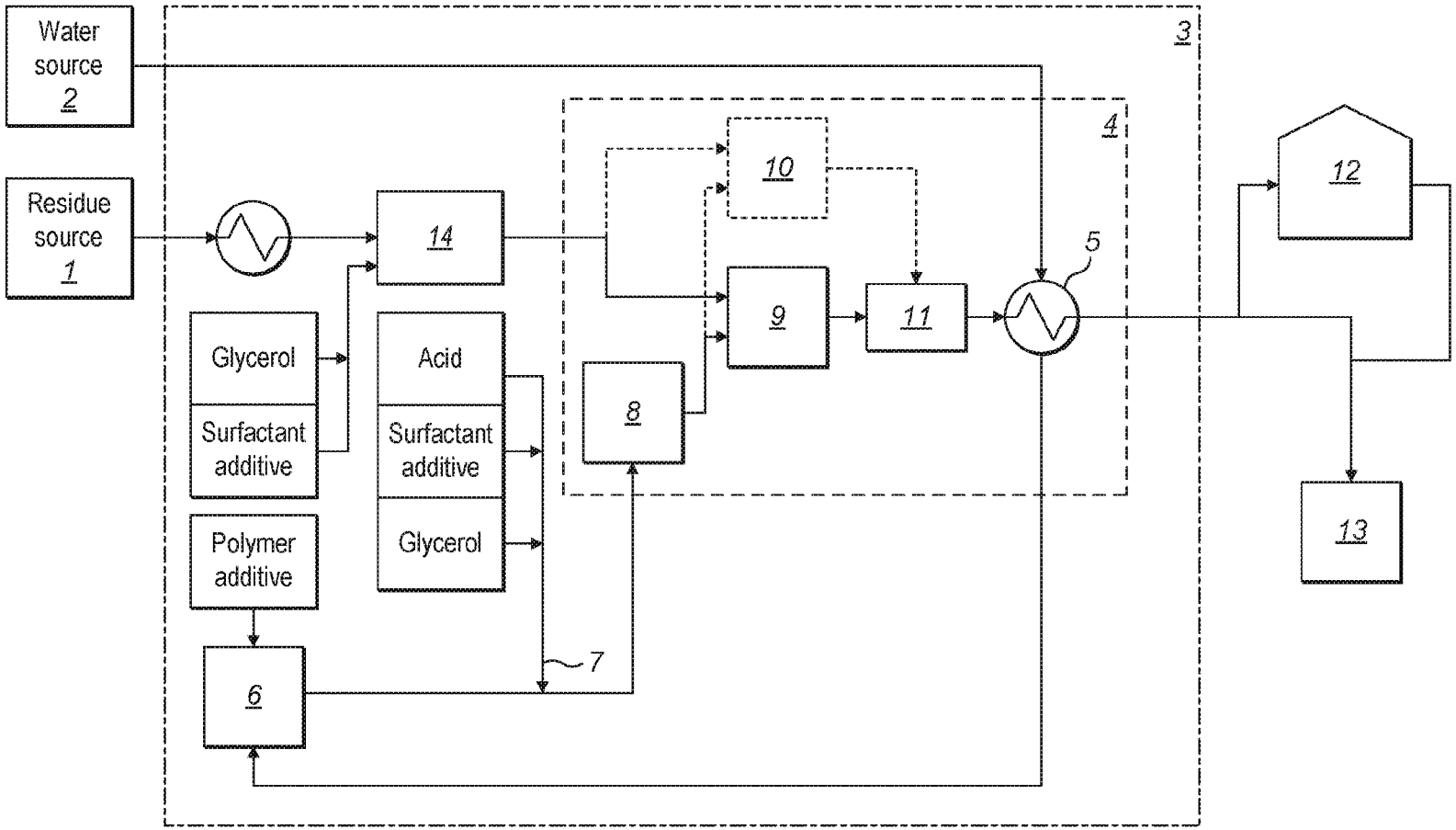
FIG. 3 shows a schematic of a process for producing an oil-in-water emulsion wherein glycerol is present in both the aqueous phase and the oil phase, as described herein.

Non-limiting example schematics of a process for preparing an oil-in-water emulsion are given in FIGS. 1, 2 and 3. In FIGS. 1, 2 and 3, the boxes marked "glycerol" may contain the $C_1$ to $C_{10}$ mono or di hydric alcohol in embodiments in which the oil-in-water emulsion comprises a $C_1$ to $C_{10}$ mono or di hydric alcohol. That is, the $C_1$ to $C_{10}$ mono or di hydric alcohol may be mixed with the glycerol.

A non-limiting example schematic of a process for preparing an oil-in-water emulsion wherein the glycerol is present in the aqueous phase is given in FIG. 1. The area designated (1) represents the source of hydrocarbon-containing oil to be utilised as the oil phase for the production of the oil-in-water emulsion.

The area designated (2) represents the source of suitable water.

In the area designated (3), the material from the hydrocarbon-containing oil source (1) may be cooled by a medium to a suitable temperature for storage as required and further temperature control as required, to achieve a viscosity of between 250 to 500 cSt, for direct introduction into the emulsion preparation unit (4). Water (2) is first heated (typically to within the range 50 to 90° C.) in a heat exchanger (5) that is also utilised for cooling the final emulsion product (typically to less than 90° C.) along with supplementary cooling (typically to less than 60° C.) to enable easier handling.

In area (6), the polymeric stabiliser is optionally mixed into the aqueous phase, followed by the addition of the surfactant, organic acids (optional), and glycerol in area (7). The chemical additives can be varied if and as required to achieve an emulsion fuel with the required specification and performance criteria.

The chemical additives (surfactant, optionally organic acids, glycerol, optionally a $C_1$ to $C_{10}$ mono or di hydric alcohol, and optionally polymeric stabiliser) used preferably do not contain any components or impurities that can negatively affect the use of the resulting emulsion as a fuel. Therefore, preferably, they contribute no more than 50 ppm of halogenated compounds and no more than 100 ppm of alkali metals in the final emulsion fuel specification.

The aqueous phase passes through a tank/vessel (8), which provides sufficient residence time for the acid to fully activate the surfactant. Both the aqueous phase and the hydrocarbon-containing oil phase are then introduced into a high-shear colloidal mill (9), the speed of which is adjusted to intimately mix the components. One or more colloidal mills may be employed (10) within the manufacturing process, depending on the number of required emulsion component streams of differing properties (i.e., one for the manufacture of a single component emulsion fuel, or two or more required for the manufacture of a composite, multi-component emulsion fuel). If more than one component is manufactured, then the differing components can be passed through an in-line blender (11) or mixed downstream at the required ratios to achieve the correct properties of the final oil-in-water emulsion fuel. In this way, the characteristics of the final required droplet size distribution, hydrocarbon/water phase ratio (i.e. energy density) and viscosity/rheological characteristics can be effectively controlled.

After production, the emulsion fuel may be stored (12) for subsequent transport and supply for use as a fuel (13).

A non-limiting example schematic of a process for preparing an oil-in-water emulsion wherein the glycerol is present in the oil phase is given in FIG. 2.

In area (14), the glycerol and surfactant are mixed with the residue source to form the oil phase. Polymeric stabiliser is optionally mixed into the aqueous phase in area (6), followed by additional surfactant and optionally organic acids in area (7). The process then proceeds as described for FIG. 1.

A non-limiting example schematic of a process for preparing an oil-in-water emulsion wherein the glycerol is present in both the aqueous and the oil phase is given in FIG. 3.

In area (14), the glycerol and surfactant are mixed with the residue source to form the oil phase. In area (6), the optional polymeric stabiliser is mixed into the aqueous phase, followed by the addition of the surfactant, optionally organic acids, and glycerol in area (7). The process then proceeds as described for FIG. 1.

Process of Hydrocarbon Residue Evaluation, Formulation and Emulsification

The formulation of the oil-in-water emulsion can be optimised, depending on the nature of the hydrocarbon-containing oil, typically a hydrocarbon residue such as one of those listed in Table 1.

The chemical additives and their concentrations that can be used for different hydrocarbon residues can be optimised by a skilled person, and preferably the components are chosen so as to ensure compliance with any associated operational, performance or legislative requirements.

For the preparation of the aqueous phase containing the additives (surfactant, optionally organic acid(s), optionally polymeric stabiliser, glycerol if present in the aqueous phase), the following procedure can be used:

The volume of water to be used for the preparation of the test formulation is heated to between 50 to 70° C.

The required amount of polymeric stabiliser (if used) is added to the hot water and mixed until completely dissolved.

If the one or more organic acids are used, the pH of the solution is adjusted to be within the range 2 to 6, preferably 2 to 4.5, or 3 to 4.5.

At this stage of the preparation, the amount of the surfactant and optionally glycerol are added and the water phase is mixed while the pH is adjusted using further organic acid until the required pH is achieved. This mixing continues until all the additives are dissolved and activated.

Figure 4:
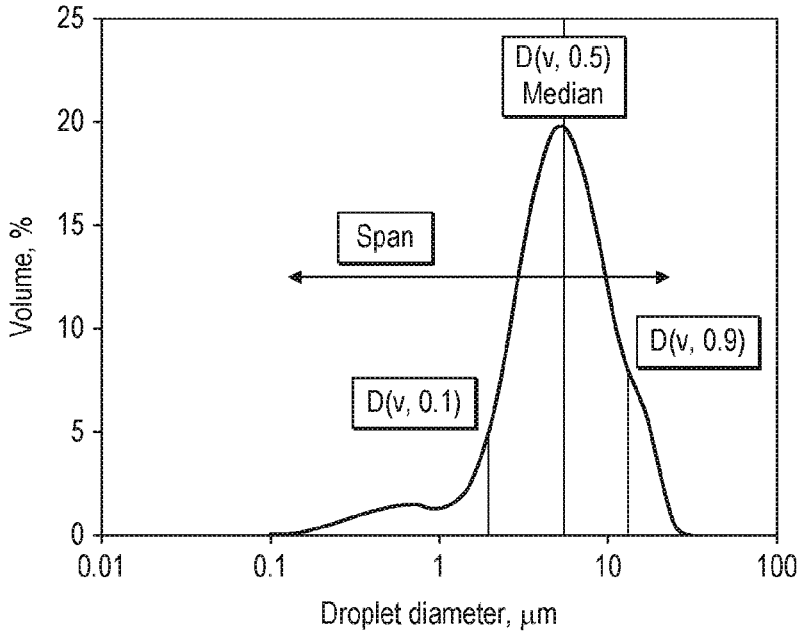
FIG. 4 shows an example of an oil-in-water emulsion fuel droplet size distribution.
Figure 5:
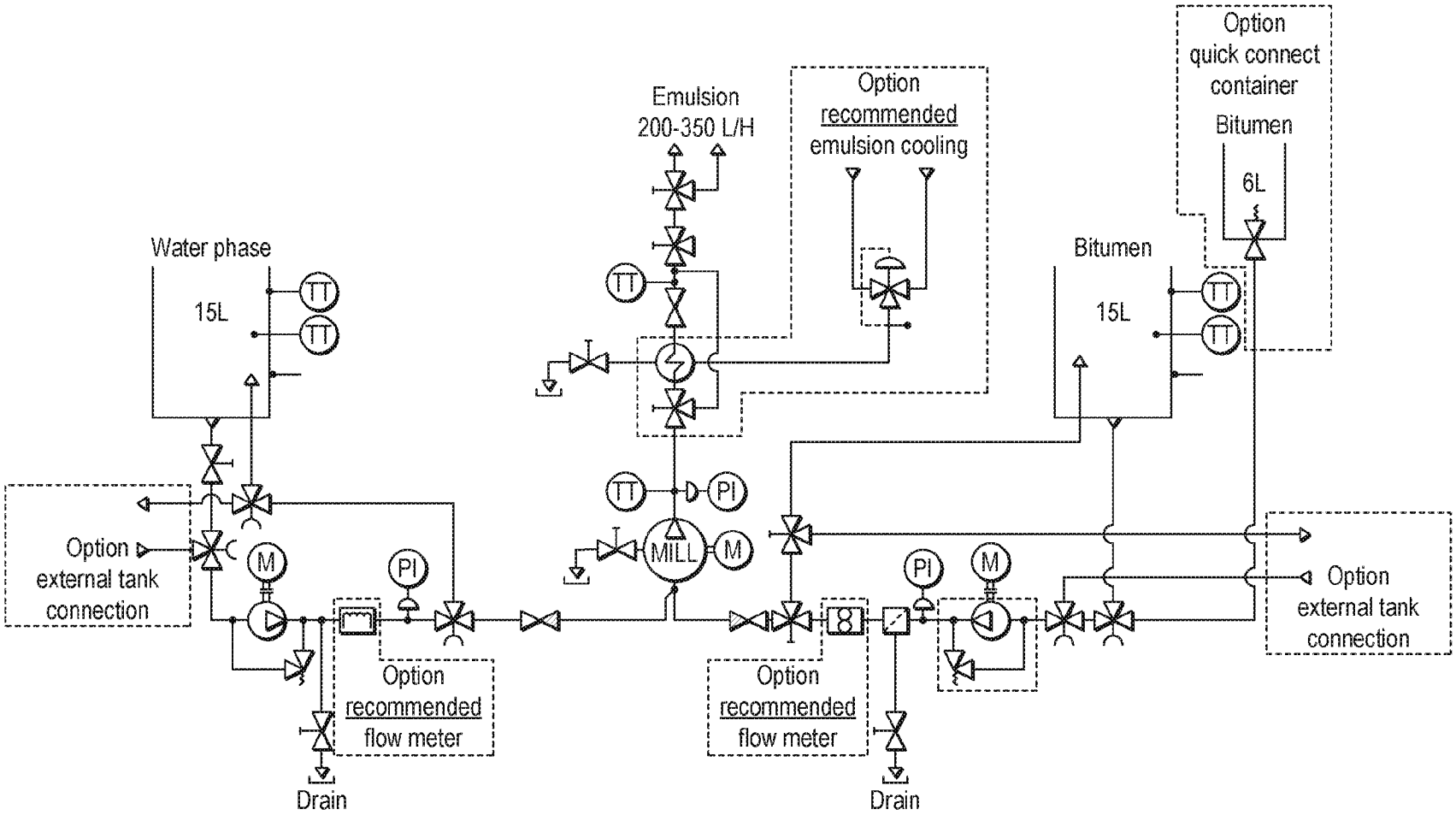
FIG. 5 shows a diagram of an example laboratory scale colloidal mill emulsification system, for the production of test formulation samples.

The aqueous phase is then transferred to a laboratory scale colloidal mill system (such as the DENIMOTECH™ SEP-0.3R Emulsion Research Plant which is capable of producing emulsions at a maximum capacity of 350 l/h, see FIG. 4). A quantity of the residue feed stock for evaluation is then introduced into the system and heated to the required temperature (as indicated above).

The test emulsion can then be prepared using the following procedure;

Flow of cooling water to the system outlet heat exchanger is started.

Pumping of the prepared water phase through the system via the colloidal mill is started.

The mill is switched on and a suitable mid-range speed selected (e.g., 9000 rpm for the SEP-0.3R system). The back pressure on the system is adjusted to approximately 2 bar.

Once steady flows and temperatures are achieved, the hydrocarbon residue pump is started at a low flow rate, and steadily increased until the required flow rate is achieved (e.g., to give a final hydrocarbon residue content in the emulsion). The backpressure of the system is adjusted to maintain a level of approximately 2 bar. The flow rate of water to the final heat exchanger is adjusted to ensure the emulsion is flowing at the outlet of the system at a temperature less than 90° C.

Once steady state operation of the system is achieved (i.e., in terms of flow rates, temperatures and pressures) a sample of the oil-in-water emulsion is taken for testing and analysis.

To stop production pumping of the residue through the system is stopped, and flow of the water phase maintained to flush the system through.

For the further evaluation and optimisation process the operating procedure of the laboratory scale colloidal mill system will be the same, with the required process and formulation variables being adjusted accordingly.

The principle of the production procedure for the manufacture of an oil-in-water emulsion fuel on a large scale using a continuous in-line plant will be the same as described above.

The analysis of these test emulsion preparations provides an indication as to the potential of a candidate hydrocarbon residue to be used as a feedstock for the production of the oil-in-water emulsion fuel by the process described using 'generic' formulation and conditions. Based on the results of these tests, further formulation matrix testing can be carried out if necessary, to fine-tune and optimise the response of the residue to emulsification and subsequent stability testing, focusing on specific aspects and variables.

The invention described above can be practiced in a variety of embodiments, non-limiting examples of which are described hereon. Example oil-in-water emulsions were prepared by the process described above. As described hereinabove, the term 'wt %' as used herein refers to the weight % of active component. For example, where the component is the surfactant, the term wt % refers to the wt % of the active surfactant.

The data clearly show a reduced sulfur content for the oil-in-water emulsions of the examples compared with the conventional emulsions A and B. The oil-in-water emulsions of the disclosure (examples 1 to 5) show significant renewable carbon content of between 7.8 wt % and 19.6 wt % and also show between 10% and 25% renewable net calorific value (NCV), compared with 0% NCV for the conventional emulsions A and B.

| Example No | Example 6 Emulsion | Comparator C |
|---|---|---|
| Residue type | Atmospheric Distillation Residue | Atmospheric Distillation Residue |
| Residue content | 58.5% | 65% |
| Glycerol content | 6.5% | 0% |
| Water content | 35% | 35% |
| W/O Surfactant 1 | 1.20% Span 80 | 1.20% Span 80 |
| W/O Surfactant 2 | 0.10% Tween 80 | 0.10% Tween 80 |
| O/W Surfactant | 0.80% AF134 | 0.80% AF134 |
| Polymer | 0.04% EM7000FQ | 0.04% EM7000FQ |
| Acid | Formic/pH = 4 | Formic/pH = 4 |
| Emulsion type | Glycerol-in-residue-in-water | |
| D50 (μm) | 4.0 | 4.0 |
| D90 (μm) | 8.3 | 8.8 |
| Dynamic viscosity (mPas, at 100 $s^{-1}$ and 50° C.) | 162 | 128 |

| | Examples | | | | | Comparator | |
|---|---|---|---|---|---|---|---|
| Example No | 1 | 2 | 3 | 4 | 5 | A | B |
| | Emulsion | | | | | | |
| Residue type | Vacuum Distillation Residue | | | | | | |
| Residue content | 60% | 50% | 50% | 50% | 40% | 68% | 70% |
| Glycerol content | 20% | 30% | 40% | 40% | 50% | 0% | 0% |
| Water content | 19.66% | 19.66% | 9.66% | 9.70% | 9.66% | 31.66% | 29.66% |
| Surfactant | 0.30% AF134 | 0.30% AF134 | 0.30% AF134 | 0.30% AF134 | 0.30% AF134 | 0.30% AF134 | 0.30% AF134 |
| Polymer | 0.04% EM7000FQ | 0.04% EM7000FQ | 0.04% EM7000FQ | none | 0.04% EM7000FQ | 0.04% EM7000FQ | 0.04% EM7000FQ |
| Acid | Formic/ pH = 4 | Formic/ pH = 4 | Formic/ pH = 4 | Formic/ pH = 4 | Formic/ pH = 4 | Formic/ pH = 4 | Formic/ pH = 4 |
| Emulsion type | Oil-in-Water (glycerol dissolved in water) | | | | | | |
| D50 (μm) | 5.4 | 4.0 | 4.4 | 4.1 | 5.8 | 4.7 | 3.3 |
| D90 (μm) | 13.4 | 12.2 | 12.7 | 20.9 | 14.9 | 15.4 | 10.6 |
| Dynamic viscosity (mPas, at 100 $s^{-1}$ and 50° C.) | 297 | 123 | 323 | 156 | 134 | 143 | 304 |
| Renewable NCV (GJ/t) | 3.2 | 4.8 | 6.4 | 6.4 | 8.0 | 0.0 | 0.0 |
| Non-renewable NCV (GJ/t) | 23.4 | 19.5 | 19.6 | 19.6 | 15.9 | 26.4 | 27.2 |
| Total NCV (GJ/t) | 26.6 | 24.3 | 26.0 | 26.0 | 23.9 | 26.4 | 27.2 |
| Renewable C | 7.8% | 11.7% | 15.6% | 15.6% | 19.6% | 0% | 0% |
| Non-renewable C | 49.3% | 41.1% | 41.1% | 41.1% | 32.8% | 53.1% | 57.5% |
| Total C | 57.1% | 52.8% | 56.7% | 56.7% | 52.4% | 53.1% | 57.5% |
| Sulfur content | 1.87% | 1.56% | 1.56% | 1.56% | 1.24% | 2.11% | 2.18% |

AF134 = Alkyl diamine ethoxylate
EM7000FQ = ethyl, methyl, hydroxyethyl cellulose
Formic = formic acid
NCV = net calorific value
The surfactant used is 100% active.

-continued

| Example No | Example 6 Emulsion | Comparator C |
|---|---|---|
| Renewable NCV (GJ/t) | 1.0 | 0.0 |
| Non-renewable NCV (GJ/t) | 23.6 | 26.2 |
| Total NCV (GJ/t) | 24.6 | 26.2 |
| Renewable C | 2.5% | 0% |
| Non-renewable C | 50.5% | 56.1% |
| Total C | 53.0% | 56.1% |
| Sulfur content | 0.77% | 0.85% |

AF134=Alkyl diamine ethoxylate
EM7000FQ=ethyl, methyl, hydroxyethyl cellulose
Formic=formic acid
NCV=net calorific value
The surfactant is 100% active Again, it can be seen that, even with a relatively low glycerol content of 6.5 wt %, a significant renewable carbon source amount of 2.5% was achieved, which is favourable in respect $CO_2$ emissions. Sulfur content was also reduced compared with conventional emulsions.

| Example No. | Emulsion components Residue:glycerol:water:alcohol (wt %) | Glycerol containing phase density (g/mL @ 25° C.) Alcohol = methanol | Glycerol containing phase density (g/mL @ 25° C.) Alcohol = ethanol | Glycerol containing phase density (g/mL @ 25° C.) Alcohol = tert-butanol |
|---|---|---|---|---|
| 7 | 50:40:9.7:0 | 1.208 | 1.208 | 1.208 |
| 8 | 50:38:9.7:2 | 1.186 | 1.188 | 1.186 |
| 9 | 50:30:9.7:10 | 1.103 | 1.104 | 1.097 |
| 10 | 50:25:9.7:15 | 1.053 | 1.053 | 1.043 |
| 11 | 50:20:9.7:20 | 1.006 | 1.005 | 0.993 |
| 12 | 50:15:9.7:25 | 0.964 | 0.963 | 0.950 |

In each of examples 7 to 12, the emulsion also comprises 0.3 wt % AF134 (alkyl diamine ethoxylate). The examples also comprise formic acid (pH 4) and the residue type is Vacuum Distillation Residue.

The data clearly show that the addition of an alcohol to the oil in water emulsion results in a glycerol containing phase with a significantly improved density.

The invention claimed is:

1. An oil-in-water emulsion comprising an oil phase dispersed in an aqueous phase, the oil-in-water emulsion comprising:

from 0.05 to 0.6 wt % of a surfactant selected from the group consisting of fatty alkyl amines, ethoxylated fatty alkylamines, ethoxylated fatty alkyl monoamines, methylated fatty alkyl monoamines, methylated fatty alkyl amines, and quaternary fatty alkyl amines, or a combination thereof;

one or more organic acids selected from the group consisting of: methanesulfonic acid, formic acid, acetic acid, citric acid, benzoic acid, p-toluenesulfonic acid, and combinations thereof;

up to 50 wt % hydrocarbon residue;

from about 0.5 to about 70 wt % of an alcohol selected from the group consisting of: $C_1$ to $C_6$ mono or di hydric alcohols; and from 30 to 70 wt % glycerol;

wherein the oil-in-water emulsion has the following characteristics:

an average droplet size (D[4,3]) of from 3 to 15 μm;

less than 3 wt % of the droplets have a particle size of greater than 125 μm; and a dynamic viscosity of up to 500 mPas at 50° C. and 100 $s^{-1}$, wherein viscosity is measured on a Malvern Kinexus™ instrument.

2. An oil-in-water emulsion according to claim 1, wherein the oil of the oil-phase comprises a hydrocarbon residue derived from one or more of; processed heavy crude oil or natural bitumen; refinery atmospheric distillation; refinery vacuum distillation; refinery visbreaking, thermal cracking or steam cracking; refinery cat-cracking; refinery hydroprocessing and hydrocracking; and de-asphalting processes; and/or the hydrocarbon is a hydrocarbon residue selected from those having Chemical Abstracts Service (CAS) Registry Numbers 8052-42-4, 64741-45-3, 64741-56-6, 64741-67-9, 64741-75-9, 64741-80-6, 64742-07-0, 64742-78-5, 64742-85-4, 68748-13-7, 68783-13-1, 70913-85-8, 91995-23-2 or 92062-05-0, or combinations thereof.

3. An oil-in-water emulsion according to claim 1, comprising up to 40 wt % hydrocarbon residue, wherein the sum of ingredients in the emulsion does not exceed 100 wt %.

4. An oil-in-water emulsion according to claim 1, comprising from about 0.5 to about 70 wt % of an alcohol selected from the group consisting of $C_1$ to $C_4$ mono or di hydric alcohols, wherein the sum of components in the emulsion does not exceed 100 wt %.

5. An oil-in-water emulsion according to claim 4, wherein the alcohol is selected from the group consisting of methanol, ethanol, and butanol.

6. An oil-in-water emulsion according to claim 1, wherein the glycerol's contribution to the ash content of the fuel is less than 0.5 wt %.

7. An oil-in-water emulsion according to claim 1, wherein the emulsion and/or the aqueous phase has a pH of from 2 to 6.

8. An oil-in-water emulsion according to claim 1, wherein the oil-in-water emulsion further comprises a polymeric stabiliser.

9. An oil-in-water emulsion according to claim 8, wherein the polymeric stabiliser is selected from the group consisting of dialkylaminoalkyl acrylate or dialkylaminoalkyl methacrylate quaternary salts such as dimethylaminoethyl acrylate methyl chloride quaternary salt, dimethylaminoethyl acrylate methyl sulfate quaternary salt, dimethylaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, or dialkylaminoalkylacrylamides or methacrylamides and their quaternary salts such as acrylamidopropyltrimethylammonium chloride, dimethylaminopropyl acrylamide methyl sulfate quaternary salt, dimethylaminopropyl acrylamide methyl saulfate quaternary salt, dimethylaminopropyl acrylamide sulfuric acid salt, dimethylaminopropyl acrylamide hydrochloride salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldimethylammonium chloride, and diallyldimethylammonium chloride, and combinations thereof.

10. An oil-in-water emulsion according to claim 1, wherein the oil-in-water emulsion comprises from 0.03 to 0.08 wt % polymeric stabilisers and wherein the sum of components in the emulsion does not exceed 100 wt %.

11. An oil-in-water emulsion according to claim 1, comprising from 20 to 30 wt % hydrocarbon residue; and from 40 to 70 wt % glycerol, wherein the sum of components in the emulsion does not exceed 100 wt %.

12. A fuel composition comprising or consisting of the oil-in-water emulsion as defined in claim 1.

13. A fuel composition according to claim 12 which is a diesel fuel; or which is a diesel fuel; or which is a marine fuel; or which is a fuel oil for heat and power utility applications.

14. A process for preparing the oil-in-water emulsion fuel as defined in claim 1, the process comprising the steps of:

heating a hydrocarbon-containing oil and optionally glycerol to form the oil phase;

mixing water, the surfactant, and optionally glycerol to form an aqueous solution; and blending the oil phase and the aqueous solution under conditions sufficient to form an oil-in-water emulsion;

wherein glycerol is present in the oil phase, or in the aqueous phase, or in the oil phase and the aqueous phase.

15. An oil-in-water emulsion according to claim 1, comprising from 20 to 30 wt % hydrocarbon residue; and from 40 to 70 wt % glycerol, wherein the sum of components in the emulsion does not exceed 100 wt %.

16. An oil-in-water emulsion according to claim 1, comprising a polymeric stabiliser, from 20 to 30 wt % hydrocarbon residue; and from 40 to 70 wt % glycerol, wherein the sum of components in the emulsion does not exceed 100 wt %.

17. An oil-in-water emulsion according to claim 1, wherein at least a portion of the glycerol is comprised in the oil phase.

18. An oil-in-water emulsion according to claim 1, wherein the oil of the oil-phase consists of a hydrocarbon residue derived from one or more of, processed heavy crude oil or natural bitumen; refinery atmospheric distillation; refinery vacuum distillation;

refinery visbreaking, thermal cracking or steam cracking; refinery cat-cracking; refinery hydroprocessing and hydrocracking; and de-asphalting processes; and/or the hydrocarbon consists of a hydrocarbon residue selected from those having Chemical Abstracts Service (CAS) Registry Numbers 8052-42-4, 64741-45-3, 64741-56-6, 64741-67-9, 64741-75-9, 64741-80-6, 64742-07-0, 64742-78-5, 64742-85-4, 68748-13-7, 68783-13-1, 70913-85-8, 91995-23-2 or 92062-05-0, or combinations thereof.

* * * * *